US005485164A

United States Patent [19]

Compton et al.

[11] Patent Number: 5,485,164

[45] Date of Patent: Jan. 16, 1996

[54] SELF-SCANNING PULSED SOURCE USING MODE-LOCKED OSCILLATOR ARRAYS

[75] Inventors: Richard C. Compton, Ithaca, N.Y.; Robert A. York, Goleta, Calif.

[73] Assignee: Cornell Research Foundation, Inc., Ithaca, N.Y.

[21] Appl. No.: 201,078

[22] Filed: Feb. 24, 1994

Related U.S. Application Data

[63] Continuation of Ser. No. 914,146, Jul. 16, 1992, abandoned.

[51] Int. Cl.[6] ..... H01Q 1/38

[52] U.S. Cl. ..... 343/700 MS; 343/754; 331/55

[58] Field of Search ..... 343/700 MS, 754; 331/55, 107 R, 112; 455/129, 107; H01Q 1/38

[56] References Cited

U.S. PATENT DOCUMENTS

| | | | |
|---|---|---|---|
| 3,628,186 | 12/1971 | Ashkin | 331/175 |
| 3,778,717 | 12/1973 | Okoshi et al. | 343/700 MS |
| 4,040,728 | 8/1977 | Seidel | 331/55 |
| 4,344,052 | 8/1982 | Davidson | 333/222 |
| 4,468,635 | 8/1984 | Lukens et al. | 331/107 S |
| 4,470,023 | 9/1984 | Lukens et al. | 331/107 S |
| 4,511,860 | 4/1985 | Bastida et al. | 331/96 |
| 4,525,732 | 6/1985 | Bayraktaroglu | 333/247 |
| 4,642,577 | 2/1987 | Bates | 331/47 |
| 4,656,438 | 4/1987 | Levinson | 330/287 |
| 4,742,314 | 5/1988 | Mink | 331/56 |

*Primary Examiner*—Donald T. Hajec
*Assistant Examiner*—Tan Ho
*Attorney, Agent, or Firm*—Jones, Tullar & Cooper

[57] ABSTRACT

An array of coupled microwave oscillators operate at equally spaced output frequencies to produce a train of high-power RF pulses. Each oscillator is embedded in a printed planar radiating structure so that they form a classical antenna array. The oscillators are coupled through weak radiative interactions and by adjusting the frequencies of the oscillators so that adjacent devices operate at equally spaced frequencies, the output from the array is a frequency spectrum of equally spaced pulses. The pulses have a pulse repetition rate which is determined by the frequency spacing and the pulse duration and peak power are a function of the square of the number of oscillators in the array. In addition, the signal scans repetitively through space above the array.

24 Claims, 5 Drawing Sheets

FIG. 1
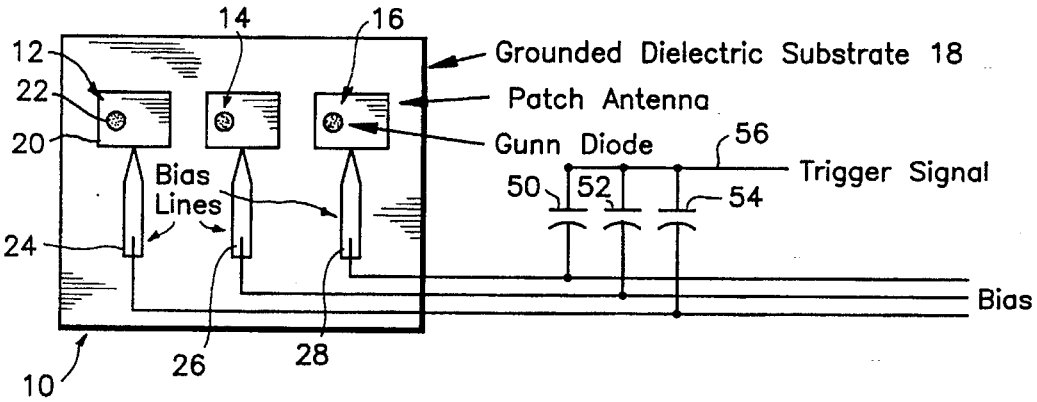
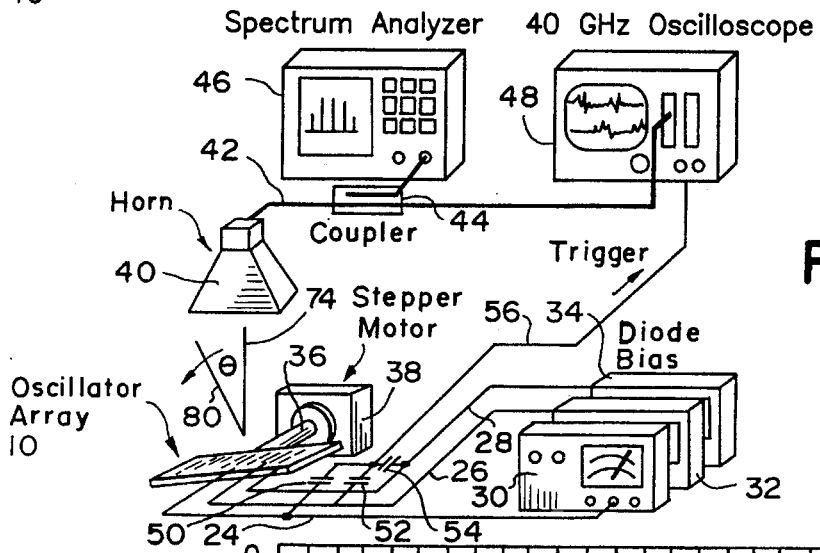
FIG. 2
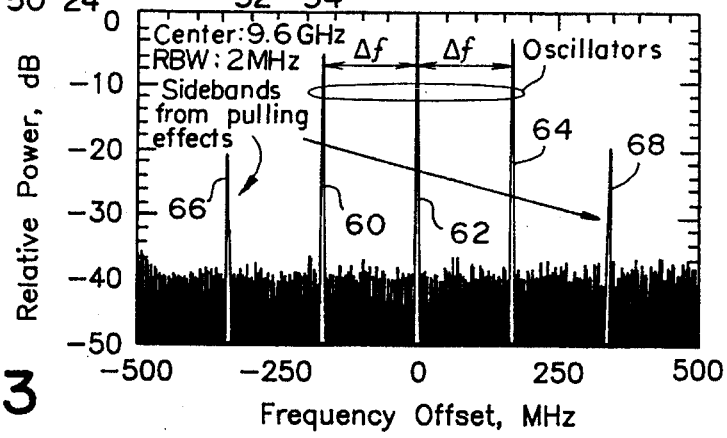
FIG. 3

FIG. 4
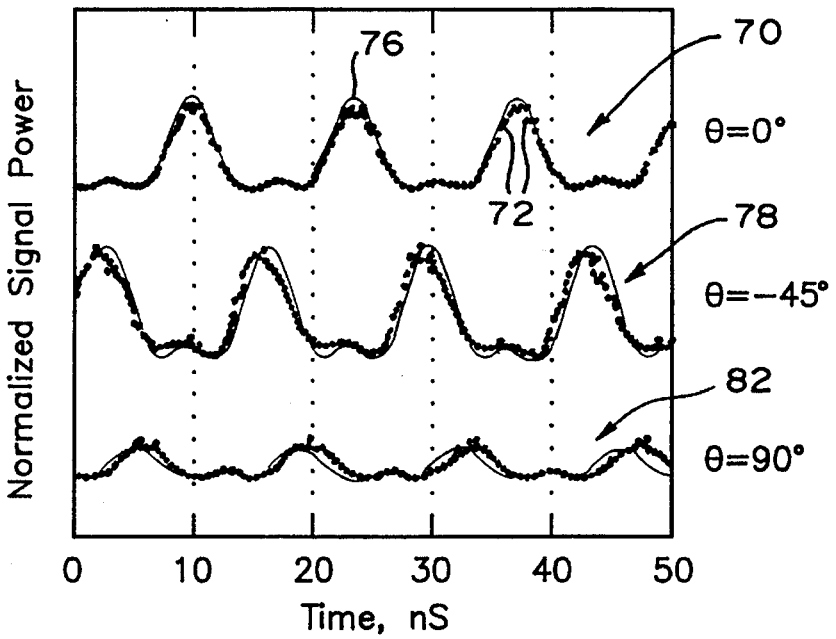
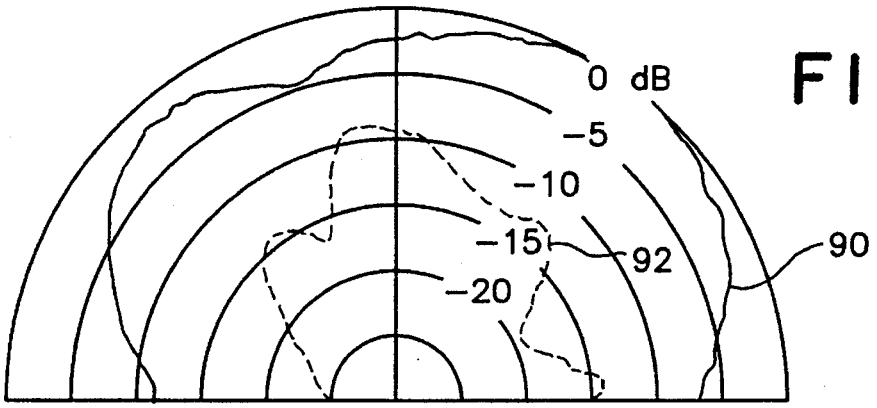
FIG. 5
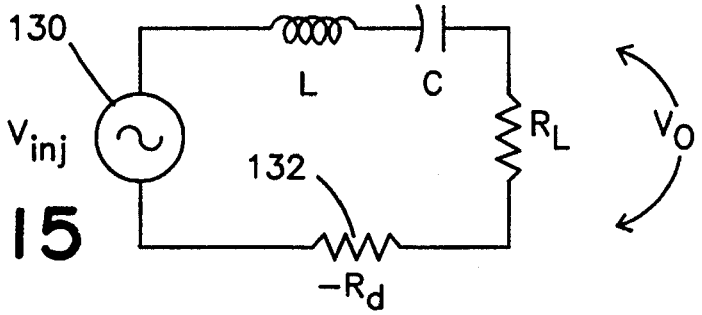
FIG. 15

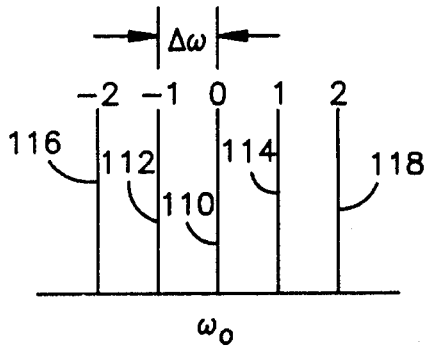
FIG. 11
FIG. 12
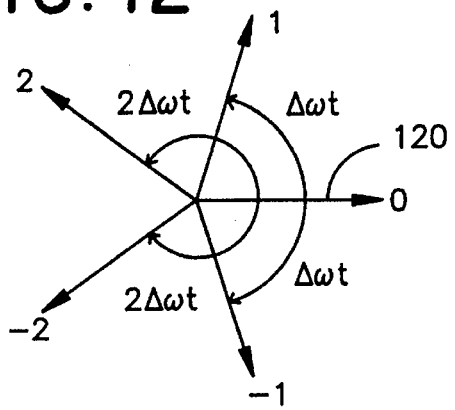
FIG. 13
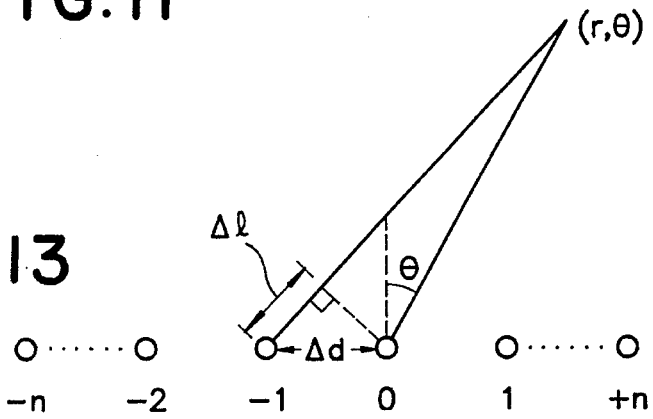
FIG. 14
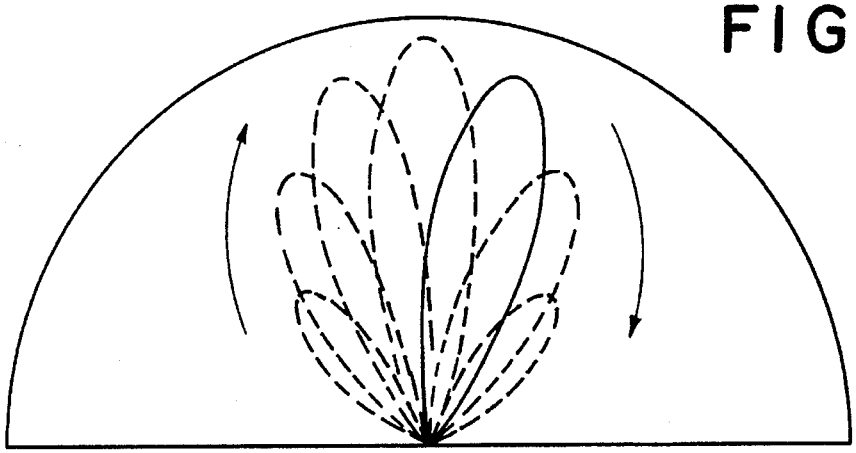

SELF-SCANNING PULSED SOURCE USING MODE-LOCKED OSCILLATOR ARRAYS

This invention was made with Government support under Grant No. DAAL 03-89-K0041, awarded by the U.S. Army Research Office The Government has certain rights in the invention. This application is a continuation of application Ser. No. 07/914,146, filed Jul. 16, 1992 now abandoned.

BACKGROUND OF THE INVENTION

The present invention relates, in general, to microwave oscillator arrays, and more particularly to a quasi-optical, solid-state antenna array wherein individual oscillator elements operate at different, equally spaced frequencies coupled in such a way as to produce either a train of high-power pulses or a beam scanning repetitively through space above the array.

The generation of high power, millimeter-wave radio frequency (RF) pulses for use in communications systems has been limited, in the past, by the fact that high-current, tube-type devices not only require high voltages (in the range of 10,000 volts), but are difficult and expensive to manufacture. Furthermore, such devices are operated at a constant power level, with pulses obtained by switching them on and off. Such operation is not only inefficient, but results in undesirable switching transients. All of these factors, together with the general lack of reliability for such devices, make them unsatisfactory. Semiconductor devices have also been not been satisfactory, for in order to achieve the requisite high frequencies, they must be small in size, yet the smaller they are, the less power they can handle. Thus, a tube-type device, even with all its other shortcomings, can produce up to one kilowatt of power at 60 GHz, while solid state devices can only expect to produce up to 1 Watt at that frequency.

One way to solve the problem of producing sufficient power with semiconductor devices is to use many power sources in parallel, and in this regard, semiconductor technology is of great benefit, for it is relatively easy to duplicate multiple semiconductor devices and to connect them in parallel. A lot of work has been done in this regard, but such work has been directed primarily to operating parallel devices all at the same frequency, as described, for example, in U.S. Pat. No. 4,742,314. Such arrangements utilize a resonator structure where reflectors on opposite sides of high frequency oscillators produce a resonant cavity with the output signal leaking through one of the reflectors. Such devices are, however, limited in power intensity and directionality, and these problems are a serious deterrent to their use. Thus, although millimeter-wave systems are of interest because of their ability to operate with smaller antennas, their wider bandwidths and better resolution for imaging than existing microwave systems, nevertheless the exploitation of the millimeter-wave spectrum has been hindered by the lack of a compact, reliable, high power solid state source at these wavelengths. As noted above, high-power vacuum tube devices are available, but their large size, weight and high voltage requirements often preclude their use. The inherently small size of solid state devices makes them much more desirable, but in order to compete with vacuum tubes, solid state sources must use large numbers of devices; however, a typical solid state system would require 200 or more devices to match the output power of a single tube device.

Until recently, integrating a large number of devices had proved to be an extremely difficult task. However, a planar, quasi-optical approach to alleviate this problem is suggested by D. B. Rutledge et al in "Quasi-Optical Power Combining Arrays", invited paper, 1990, IEEE MTT-S International Microwave Symposium Digest (Dallas) May 1990. This approach uses arrays of oscillators with integrated antenna structures. Such a system forms a classical antenna array in which the power-combining is accomplished in free space so that high combining efficiencies are possible. This approach can accommodate more devices with fewer problems than the conventional methods of power combining. To date, however, work in this area has concentrated on synchronizing all elements of the array to the same frequency with identical phases. This produces a constant, coherent (CW) output signal. However, many applications require a pulsed source of brief, high-energy bursts of radiation, rather than a constant signal.

SUMMARY OF THE INVENTION

It is, therefore, an object of the present invention to produce a source of high peak power, short duration, radio frequency pulses in the millimeter wave range.

It is another object of the present invention to produce a high-power millimeter-wave source having a scanning capability.

Briefly, the present invention is directed to a mode-locked, solid-state, power combining radiating array for use at microwave and millimeter wave frequencies. The array consists of many individual oscillator elements, each of which, in turn, consists of a solid-state power device embedded in a planar radiating structure. Each oscillator radiates its energy into the free space above the array so that each device acts as a conventional transmitting antenna. Mode-locking is achieved by adjusting the individual oscillators to operate at different, equally spaced frequencies, with nearly equal amplitudes. When this is done, the oscillator phases become "locked" through mutual coupling interactions between the oscillators, and a train of high-power pulses is produced. The duration and peak power of the radiated pulses are determined by the number of oscillators in the array, with the peak power of each pulse being proportional to the square of the number of oscillators. The pulse repetition rate is determined by the frequency spacing. The pulses will be in the form of a pulse train if they radiate from one location or will scan repetitively through the space above the array if the radiators are spaced, in which case if the output is observed at different relative times from a fixed spot, the observer will see a single pulse for each scan of the output.

In accordance with one embodiment of the invention, a plurality of oscillators are provided, each oscillator consisting of a radiating element such as a patch antenna and an active device such as a Gunn diode. Such devices, described by H. J. Thomas et al, in "Gunn Source Integrated with Microstrip Patch", *Microwaves RF*, pp. 87–89, February 1985, are arranged side-by-side to form a linear array and each is biased to oscillation at, for example, a frequency in the range of 11 GHz. The bias voltage applied to each oscillator can be adjusted to slightly vary the oscillator frequency, with the frequency difference between each adjacent pair being such as to provide passive, or self mode locking and to provide equally spaced spectral components in the radiated signal. Thus, for example, five oscillator elements may be operated at frequencies (fo–2Δf), ($f_o$–1Δf), $f_o$, ($f_o$+1Δf), and ($f_o$+2Δf). Such differences in frequencies avoid synchronous oscillation of the oscillators and thus avoid the continuous wave output signals of prior arrays. Adjustments of the oscillator frequency are carried out while all of the oscillators are operating and are interacting to provide mode locking, with the radiated spectrum being monitored while the frequencies are adjusted to obtain the desired spectral spacing.

Alternatively, one or more of the elements may be frequency modulated by, for example, capacitively coupling an RF modulation signal to the element biasing line to provide active mode locking. In this operation, the modulating signal is the difference frequency $\Delta f$ between adjacent spatial components in the radiated signal.

Mode locking is produced by mutual pulling effects between the oscillators in the array due to radiative coupling mechanisms. Thus, for example, a single radiated RF signal at a frequency $f_o$ has a phase vector $A_1$ which rotates at an angular frequency $\omega_o$. If a second radiated RF signal is introduced having a different frequency (e.g., $f_o+\Delta f$), it will have a phase vector $A_2$ which rotates at a different angular frequency $\omega_1$. The resultant signal will vary as a function of time, and whenever the vectors coincide along the X-axis of the phase vector, the radiated power will be proportional to $(A_1+A_2)^2$. As additional radiating elements at different frequencies are added, the peak power increases, while the resultant power between peaks is reduced. Thus, peak power pulses are provided without switching, but with all radiating elements operating at continuous power. The coupling of these signals can be controlled by the element spacing or by using a quasi-optical reflector above the array. Such a reflector may be a dielectric material which forms a Fabry-Perot cavity with the oscillator array. Since the oscillators have typically low Q-factors of 20 to 30, the external cavity produced by such a reflector can also help to stabilize the operation of the array.

The foregoing array produces output, or radiated, pulses having a peak power which is the square of the number of devices in the array, with the pulses having a repetition rate corresponding to the frequency spacing $\Delta f$ between the oscillators in the array. The output is spatially scanned above the array as in a phased array source, but without phase shifters. The scanning coverage by the radiated pulses is dependent on element spacing, while the pulse repetition frequency is dependent on the spectral spacing. Since the individual elements of the array operate in a continuous wave mode to produce the resultant pulsed output, there are no thermal restrictions on the pulse repetition frequencies so that short, high-power RF pulses are scanned automatically through the space above the array. If the individual oscillators all radiate from the same point in space a periodic pulse train is produced, similar to a mode-locked laser. If, however, the oscillators each radiate from spatially separated antennas the resulting output signal scans across the space above the array, rather than pulsing on and off. An observer at a fixed point with respect to the array sees a pulse as the beam scans across his location.

The output signal radiates in all directions from the surfaces of the radiating elements, and each such element can be low cost, compact, and easily reproducible. Such elements can individually operate at relatively low power, but the mode locked output pulses will be of high instantaneous power. A receiver tuned to any single transmitted frequency, e.g., $f_o$, would only receive the low-power signal, whereas a receiver tuned to, e.g., all five frequencies transmitted by five oscillators, as noted above, would receive the mode locked peak pulses. Thus, even if each transmitter individually radiated signals below the level of the background noise, the peak signals would still be detectable to permit, for example, secure communication or to permit location of the array.

Although the invention will be described herein in terms of a linear array of radiating elements, it will be understood that various arrangements such as a 2-dimensional array of oscillator elements may be used.

BRIEF DESCRIPTION OF THE DRAWINGS

The foregoing, and additional objects, features and advantages of the present invention will become apparent to those of skill in the art from the following detailed description of preferred embodiments, thereof, taken in conjunction with the accompanying drawings, in which:

FIG. 1 is a diagrammatic illustration of a linear array of oscillators employing Gunn diodes mounted in patch antennas, showing three antenna elements;

FIG. 2 is a diagrammatic illustration of an experimental set up for measuring pulses radiated by a passively mode locked antenna array;

FIG. 3 is a diagrammatic representation of the spectrum produced by three mode-locked microwave oscillators;

FIG. 4 is a graphical depiction of the waveforms for a three element patch array at three scan angles;

FIG. 5 is an E-plane pattern measurement for a single active patch antenna, showing in dashed lines the cross-polarization signal;

FIG. 11 is a diagrammatic illustration of the frequency spectrum of a five element, mode-locked oscillator array;

FIG. 12 is an instantaneous phase diagram of the radiated signals from a five-element, mode-locked oscillator array;

FIG. 13 illustrates the relationship of the elements of a five-element array;

FIG. 14 is a polar antenna plot simulating scanning for a five-element mode-locked array using patch antennas spaced one-half wavelength apart;

FIG. 15 is a circuit model for a single oscillator;

DESCRIPTION OF PREFERRED EMBODIMENT

Figure 6:
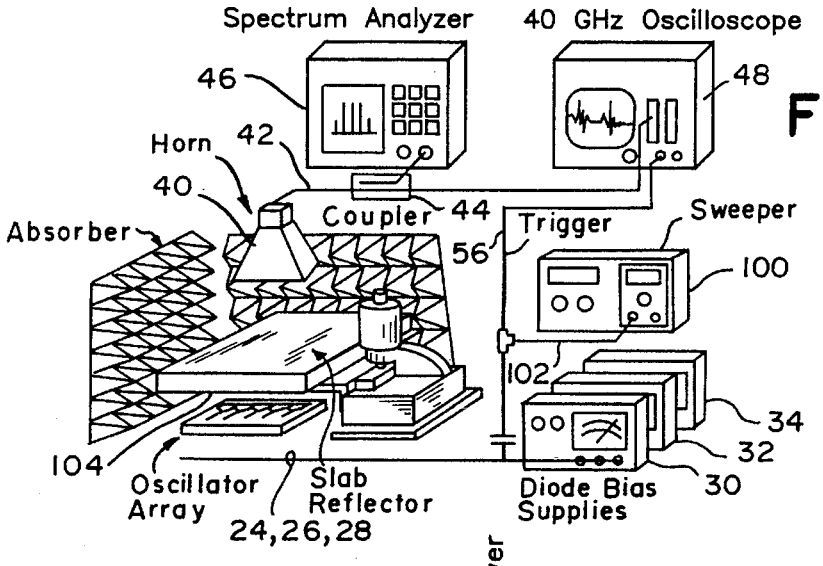
FIG. 6 is a diagrammatic illustration of an experimental set up for measuring pulses radiated by an actively mode locked antenna array.
Figure 7:
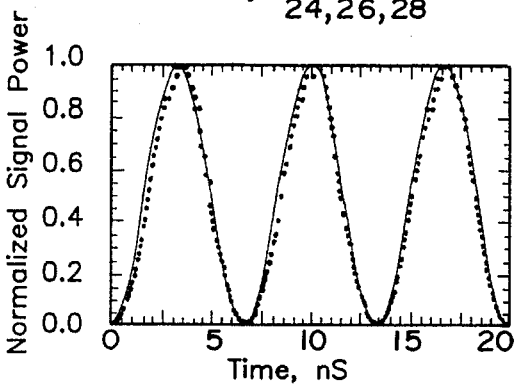
FIG. 7 is a graphical depiction of the time dependance of the resultant radiated signal from two mode-locked oscillators.
Figure 9:
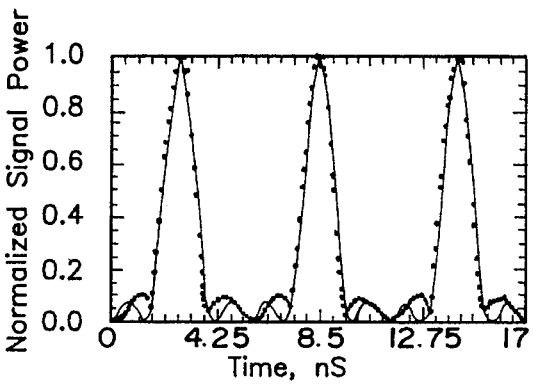
FIG. 9 is a graphical depiction of the time dependance of the resultant radiated signal from four mode-locked oscillators.
Figure 8:
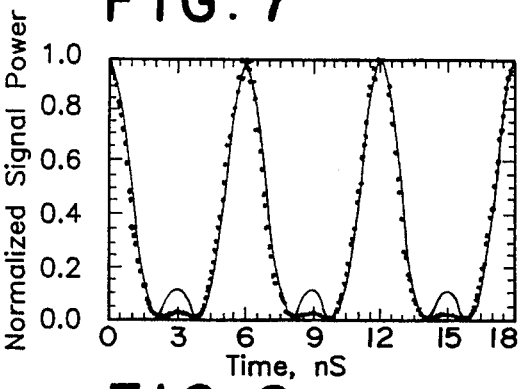
FIG. 8 is a graphical depiction of the time dependance of the resultant radiated signal from three mode-locked oscillators.
Figure 10:
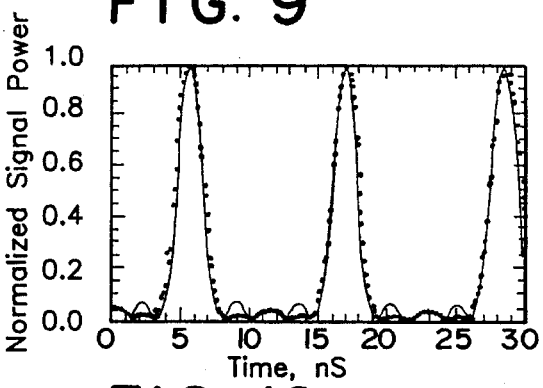
FIG. 10 is a graphical depiction of the time dependance of the resultant radiated signal from four five mode-locked oscillators.

Turning now to a more detailed description of the invention, there is illustrated in FIG. 1 in diagrammatic form a three-element oscillator linear array 10 utilizing active patch antennas. The three-element array includes oscillator elements 12, 14 and 16 mounted on a grounded dielectric substrate 18 which serves as a ground plane for the antenna elements. Element 12 is typical of the oscillator elements 12, 14 and 16, and includes a printed patch antenna 20 which serves as a radiating element, and a Gunn diode 22, with the Gunn diode being mounted between the patch antenna and the ground plane 18.

The Gunn diode may be a commercially available MA/COM packaged diode. Each of the radiating elements 20 may measure 9.5 mm ×8.0 mm, in one embodiment of the invention, with the diode located 2.0 mm from the edge of the antenna element. The substrate 18 may be 60 mil thick, with a relative dielectric constant of 4.1. The oscillator elements 12, 14 and 16 are separated by distances of about ¼ the wavelength of the oscillation frequency, and are biased by way of corresponding bias lines 24, 26 and 28 connected to corresponding bias sources 30, 32 and 34 (FIG. 2). The bias voltage is applied at a low impedance point on a non-radiating edge of each of the corresponding radiating elements 12, 14 and 16, with a bias of 10 volts giving, in a preferred embodiment, 11 GHz oscillations. In one form of the invention, each bias source is adjustable to control the frequency of its corresponding oscillator.

An experimental setup to measure the radiation produced by array 10 is illustrated in FIG. 2, wherein the array is mounted on the shaft 36 of a stepper motor 38 which rotates the array in its E-plane, which is the plane of scanning. A receiving horn 40 is positioned in the far field above array 10 and the received signal is supplied by way of line 42 through a coupler 44 to a spectrum analyzer 46 and directly to a sampling oscilloscope 48. A trigger signal for the oscilloscope is derived from the bias lines 24, 26, and 28 by way of corresponding capacitive couplers 50, 52 and 54 and through line 56 to a corresponding input to the oscilloscope. Although little of the RF signal generated by the array 10 is present on the bias lines 24, 26 and 28, low frequency components corresponding to the repetition rate of the output high power pulse envelope are present on these lines and can be used to derive the triggering signal which is supplied by way of line 56 to the high speed sampling oscilloscope 48. This trigger signal permits the pulse envelope detected by horn 40 to be displayed on the oscilloscope. The trigger signal is independent of the array orientation; i.e., is independent of the rotational angle θ of the array in FIG. 2, and therefore serves as a time reference for comparing the output waveforms at different angles. With this arrangement, the output, or radiated waveforms are observed to shift in time on the oscilloscope screen as the array is rotated beneath horn 40.

Self mode-locking of the oscillators 12, 14 and 16 is established by adjusting the oscillation frequencies of each element, using corresponding adjustable bias supplies 30, 32 and 34 to produce equally spaced spectral components such as the components 60, 62 and 64 illustrated in the spectrum of FIG. 3, which is obtained from the spectrum analyzer 46 of FIG. 2. Thus, for example, element 12 radiates at the frequency of spectral component 60, element 14 radiates at frequency 62, and element 16 radiates at frequency 64. In addition, side bands such as those illustrated at 66 and 68 are produced. Because of the mutual pulling effects between the oscillators which arise due to radiative coupling mechanisms, the adjustment of oscillation frequencies to obtain equally spaced spectral components must be performed with all elements operating simultaneously. The spectrum of a pulled oscillator is described by R. A. York et al, in "Quasi-Optical Power-Combining Using Mutually Synchronized Oscillator Arrays", IEEE Trans. Microwave Theory Tech., Vol. 39, No. 6, pp. 100–1009, June 1991.

With the oscillation frequencies of the elements adjusted to produce equally spaced spectral components, as discussed above, the phase differences between the radiated signals cause a resultant periodic train of high power output pulses to be produced by the array 10, which can be observed on the signal analyzer. The waveforms shown in FIG. 4 were produced by the spectrum analyzer 46 in an experimental operation of the system as described above with a three-element patch array. The resultant waveform, indicated at 70, includes measured values, indicated by circles 72, obtained at horn 40 when the array 10 was in a plane perpendicular to the axis 74 of the horn. Waveform 70, in addition to the measured values 72, includes a curve 76 which represents theoretical values, and as shown, these theoretical values agree exceptionally well with the measurements.

Waveform 78 of FIG. 4 illustrates the resultant pulsed output for a three-element patch array with the plane of the array being perpendicular to a line 80 which is at an angle e with respect to axis 74, and where θ is equal to 45°. It will be noted that the resultant waveform 78 is time shifted with respect to waveform 70, clearly indicating the scanning behavior of the waves produced by array 10.

Waveform 82 of FIG. 4 illustrates the resultant waveform when angle θ equals 90°. This waveform is clearly reduced in magnitude, but further indicates the scanning behavior of the waveforms.

The E-plane radiation pattern for a single active patch antenna is illustrated in FIG. 5 by the curve 90, with the cross-polarization signal being indicated by the dashed curve 92. This radiation pattern from each of the radiating elements produces the pulling effects between the adjacent oscillators.

The use of an active mode-locking scheme in place of the foregoing passive, or self mode-locking has been found to increase the stability and reproducibility of the waveforms radiated by the array. Such an active scheme is illustrated in FIG. 6, wherein one or more of the oscillator elements are frequency modulated by a signal having a frequency equal to $\Delta f$ so as to produce resultant oscillator outputs having the spectrum of FIG. 3. This modulation signal is provided by an RF sweeper 100 which is connected by way of line 102 to the trigger line 56 and thus is capacitively coupled to the bias lines 24, 26, and 28 in the manner described with respect to FIG. 2. The modulation of at least one of the oscillator elements generates side bands as described above, which, through mutual pulling effects due to radiative coupling mechanisms, mode-lock (or "injection"-lock) the neighboring array elements.

The coupling between antenna elements can be controlled by the element spacing or, if desired, by using a quasi-optical reflector such as the reflector 104 illustrated in FIG. 6. This reflector forms a Fabry-Perot cavity with the oscillator array and tends to stabilize the array. Active mode locking for 2, 3, 4 and 5 oscillator elements has been verified in tests, as illustrated in the waveforms of FIGS. 7, 8, 9, and 10, respectively. Each of these waveforms shows measured values as circles 106 and theoretical values as curves 108, the theoretical curves being based on the assumption of equal amplitudes for the radiated curves. An even better agreement between measured and theoretical values can be obtained by accounting for the slightly non-uniform oscillator amplitudes and the additional side bands. The curves show the time dependence of the output signal power envelope of the mode-locked oscillators, with the theoretical curves being given by $$[A(t)/E_o]^2 \quad \text{(Eq. 1)}$$

which will be further described below.

The frequency spectrum of a 5-element mode-locked oscillator array is illustrated in FIG. 11 in diagrammatic form. Thus, the peaks 110, 112, 114, 116 and 118 represent a linear array of five corresponding oscillator elements operating at individual oscillation frequencies to produce the "comb" spectrum, with the angular frequency components being equally spaced by $\Delta\omega$. Even for a relatively small array of five elements, mode-locking results in peak powers that are approximately 25 times the power obtained from a single element. Furthermore, high-pulse repetition rates can be produced quite easily.

The mode-locking phenomenon can be easily understood by representing the oscillation modes of the individual array elements as a set of rotating phase vectors 2, 1, 0, −1 and −2, in the complex plane, as illustrated in FIG. 12. It is assumed that there are N=2n+1 modes (where N is the number of modes locked) with angular frequencies:

$$\omega=\omega_o-1\Delta\omega,\ 2=-n,\ldots,n, \quad \text{(Eq. 2)}$$

where 2 is the mode index and the phases are locked such that:

$$\Phi_l-\Phi_{l-1}=\Phi,\ l=-n+1,\ldots,n, \quad \text{(Eq. 3)}$$

and that all modes have the same amplitude $E_o$. The phase vectors rotate at an angular frequency $\omega$ given by equation (2), but if the frame of reference is shifted to rotate at $\omega_o$, then the 2=0 mode indicated by line 120 in FIG. 12 will be stationary and the other phase vectors will rotate with respect to the zero mode at $l\Delta\omega$, which will be clockwise or counterclockwise depending on the sign of l. At a time t'=0, all the phase vectors line up and the signal will be a maximum. The phase vectors will again line up at time:

$$t'=2\pi/\Delta\omega \quad \text{(Eq. 4)}$$

Mathematically, the total electric field can be written as $$\begin{aligned} E(t) &= \sum_{l=-n}^{n} E_0\exp\{j[(\omega_0-l\Delta\omega)t+l\phi]\} \\ &= A(t)\exp(j\omega_0 t), \end{aligned} \quad \text{(Eq. 5)}$$

where A(t) is given by $$A(t')=E_0\frac{\sin[(2n+1)\Delta\omega t'/2]}{\sin[\Delta\omega t'/2]}, \quad \text{(Eq. 6)}$$

and $$\Delta\omega_{t'}=\Delta\omega_t+\phi \quad \text{(Eq. 7)}$$

The output signal has the form of a carrier signal at frequency $\omega$, amplitude modulated by a periodic train of pulses, where A(t) is the modulation with a pulse repetition frequency of $\Delta\omega$. The maximum amplitude at t'=0 is given by $$\lim_{t'\to 0} E_0\frac{\sin[(2n+1)\Delta\omega t'/2]}{\sin[\Delta\omega t'/2]}=E_0(2n+1), \quad \text{(Eq. 8)}$$

corresponding to a peak power proportional to $$E_o^2(2n+1)^2 \quad \text{(Eq. 9)}$$

If the elements were synchronized to the same frequency (as in a power-combining array), the average output power would be $$E_o^2(2n+1) \quad \text{(Eq. 10)}$$

The present invention utilizes mode-locking concepts analogous to those of lasers, but the mode locking phenomenon differs from the optical case because the coupling between oscillators tends to pull the oscillators. The goal of the present invention is to coax the oscillator element array into a condition which satisfies equations 2 and 3, and this is accomplished in accordance with the present invention by proper adjustment of the oscillator frequencies, although the operation of the device is subject to certain constraints on parameters such as the coupling mechanism and frequency separation.

When an external signal is injected into an oscillator, with the external signal being outside the locking bandwidth of the oscillator; i.e., the bandwidth in which the oscillator will not lock to the external signal, a spectrum of frequencies due to beating effects is produced. The additional frequencies are equally spaced by an amount proportional to the difference between the injected and the free-running frequency of the oscillator. In addition, there is a constant phase progression among these additional spectral components with the result that the pulled oscillator spectrum satisfies the conditions of equations (2) and (3). A similar but double-sided spectrum is obtained for two coupled oscillators. In a mode-locked array, these additional spectral components arising from the mutual pulling effects are used to injection-lock other oscillators in the system so that the two key requirements for mode locking set out in equations (2) and (3) can be realized. This has been verified experimentally, with the measured output signal power envelope for a linear array of five oscillators being shown in FIG. 10, as discussed above.

When the individual oscillators in a linear array are spaced apart at distances comparable to a wavelength at the carrier frequency, the output signal is constantly scanned in the space above the array. FIG. 13 is a diagrammatic illustration of the linear array trigonometry, with an observation point at (r, θ) being assumed to be in the far field. As θ is varied, the apparent phase progression on the array is changed, which effectively shifts the beam in time so that the signal is constantly scanned through the space above the array. Accordingly, the total electric field above the array can be written as $$E(r,\theta,t)=\sum_{i=-n}^{+n} E_iG(\theta)\exp\{j[(\omega_i t+\phi_i+ik_0\Delta l]\} \quad \text{(Eq. 11)}$$

where $k_0$ is the free space propagation constant, G(θ) is the amplitude gain function of each antenna element, and $^{\Delta 2}$ is the path difference given by Δ2=Δd sin θ. Assuming the conditions of equations (2) and (3) and equal amplitudes, the following expression is obtained:

$$E(r,\theta,t)=E_0G(\theta)\frac{\sin[N(\Delta\omega t+\Delta\phi+k_0\Delta d\sin\theta)/2]}{\sin[(\Delta\omega t+\Delta\phi+k_0\Delta d\sin\theta)/2]}\exp j\omega_0 t \quad \text{(Eq. 12)}$$

Equation (12) has been plotted in FIG. 14 for a five-oscillator patch antenna array at several .time increments during one cycle of the pulse train. In this Figure, a simple model for patch gain function has been assumed, and the element spacing is $\lambda_0/2$, where λ0 is the free space wavelength. The amount of scan coverage is determined by the element spacing Δd and the gain function G(θ). If all the oscillators were located at a single point (Δd=0), there would be no beam scanning.

For an array of resonant radiating structures, a very simple circuit model adequately predicts experimentally observed effects. The model consists of an active device, such as a Gunn diode, embedded in a series resonant circuit, the active device being modeled by an effective negative resistance whose magnitude is amplitude dependent but frequency independent to first order. A schematic for this circuit is illustrated in FIG. 15, where a source 130 represents the interactions with neighboring oscillators. The active device is represented by a lumped negative resistance 132, with the remainder of the circuit being a single-tuned resonant circuit which minimizes harmonic effects. The circuit equation corresponding to FIG. 15 is:

$$V_{inj}=\frac{L}{R_L}\frac{dV_0}{dt}+\frac{1}{R_LC}\int V_0dt+V_0\left(1-\frac{R_d}{R_L}\right) \quad \text{(Eq. 13)}$$

where $V_0$ is the output voltage amplitude and $V_{inj}$ is the injected signal due to neighboring oscillators. For convenience, let $\delta(V_o)=1-R_d/R_L$, where the dependence of the negative resistance on amplitude has been explicitly written. If $V_{inj}=O$, then the oscillation condition would require $\delta(V_o)=O$, however, when there is an injected signal present this parameter is non-zero to accommodate the additional energy being supplied to the circuit. For a series tuned circuit $$\omega_0^2=\frac{1}{LC}\quad \frac{R_L}{L}=\frac{\omega_0}{Q}\quad R_LC=\frac{1}{\omega_0Q} \quad \text{(Eq. 14)}$$

where Q is the quality factor of the passive resonating circuit. The Q-factor is assumed to be large enough (Q>10) so that the output signal will be close to the natural resonant frequency of the circuit, $$V_o=A_o(t)exp\{j(\omega_ot+\Phi_o(t))\}=\bar{A}_oe^{j\omega ot} \quad \text{(Eq. 15)}$$

The amplitude and phase variables are allowed to be slowly varying functions of time, leading to the set of equations $$\frac{dA_0}{dt}=\frac{\omega_0}{2Q}\delta(A_0)A_0+\frac{\omega_0}{2Q}A_0Re\left\{\frac{V_{inj}}{V_0}\right\} \quad \text{(Eq. 16)}$$

$$\frac{d\phi_0}{dt}=\frac{\omega_0}{2Q}Im\left\{\frac{V_{inj}}{V_0}\right\} \quad \text{(Eq. 17)}$$

Equation (17) is recognized as Adler's equation for injection-locking as described in R. Adler, "A Study of Locking Phenomena in Oscillators" Proc IRE, Vol 34, pp 351–357, June, 1946.

The negative resistance appearing in Eq. (16), via the term $\delta(A_o)$, is a time-averaged value described by $$R_d=\frac{1}{T}\int_0^T\frac{V_d(t)}{I_d(t)}dt \quad \text{(Eq. 18)}$$

where $V_d$ and $I_d$ are the voltage and current at the terminals of the device. Consistent with the implicit assumptions of the circuit model, the simplest nonlinearity which yields a sinusoidal oscillation is a cubic relationship between the current and voltage, which gives an approximate expression for the amplitude dependence of negative resistance as $R_d(A)=a-bA^2$. The amplitude dependence of negative resistance is the mechanism responsible for the amplitude-limiting of any real oscillator. Normalizing this expression such that the free-running oscillations occur when $A_o=1$ gives $$\delta(A_o)=-\mu(l-A_o^2) \quad \text{(Eq. 19)}$$

where $\mu=b/R_L$ is a parameter representing the oscillator. With this relation, Eq. (16) is seen to be closely related to the Van der Pol equation described by B. Van der Pol in "The Nonlinear Theory of Electric Oscillations", Proc. IRE, vol. 22, pp. 1051–1085, Sept. 1934. In the following discussions Eq. (19) will be used to represent the amplitude dependence, and μ is taken as an empirically determined quantity.

For a coupled system of such oscillators, the coupling between elements can be described by a complex coupling coefficient, $K_{ij}$, where $$K_{ij}=\lambda_{ij}exp(-j\Phi_{ij})$$

for the coupling between oscillators i and j in the system. Reciprocity is assumed in the following discussion ($K_{ij}=K_{ji}$). The injected signal seen by the ith oscillator is then $$V_{inj}=\sum_{\substack{j=1\\ j\neq i}}^{N}\kappa_{ij}V_j$$

where N is the number of oscillators in the system and $V_j$ is the output signal of the jth oscillator With $A_i$ and 107$_i$ denoting the amplitude and free-running frequency of the ith oscillator, and using the instantaneous phase $\theta_i=\omega_it+\Phi_i$, a system of equations describing the coupled oscillator dynamics can be derived, giving $$\dot{A}_i=\frac{\omega_i}{2Q}\delta(A_i)A_i+\frac{\omega_i}{2Q}\sum_{\substack{j=1\\ j\neq i}}^{N}\lambda_{ij}A_j\cos(\Phi_{ij}+\theta_i-\theta_j) \quad \text{(Eq. 20)}$$

$$\dot{\theta}_i=\omega_i-\frac{\omega_i}{2Q}\sum_{\substack{j=1\\ j\neq i}}^{N}\lambda_{ij}\frac{A_j}{A_i}\sin(\Phi_{ij}+\theta_i-\theta_j)$$

$$i=1,2,\ldots,N$$

Experiments have indicated that nearest-neighbor interactions among oscillators in a radiatively coupled system are the most important.

Assuming the coupling to be the same between adjacent oscillators in the system yields $\lambda_{ij}=\lambda$ and $\Phi_{ij}=\Phi$. Using this simplification, and writing out $\delta(A_i)$ explicitly, simplifies Eq. (20) to $$A_i=\frac{\omega_i}{2Q}\mu(1-A_i^2)A_i+\frac{\omega_i}{2Q}\sum_{\substack{j=i-1\\ j\neq i}}^{i+1}A_j\cos(\Phi+\theta_i-\theta_j) \quad \text{(Eq. 21)}$$

$$\theta_i=\omega_i-\lambda\frac{\omega_i}{2Q}\sum_{\substack{j=i-1\\ j\neq i}}^{i+1}\frac{A_j}{A_i}\sin(\Phi+\theta_i-\theta_j)$$

$$i=1,2,\ldots,N$$

The relative phase differences between the oscillators is of most interest, so let $^{\Delta}\theta_i=\theta_i-\theta_{i-1}$ and $\Delta\omega_i=\omega_i-\omega_{i-1}$. Furthermore, note that the equations (21) are only valid to first order in 1/Q, and for $\Delta\omega_i>>\omega_i$. Under these assumptions the quantity $\omega_i/2Q$ is approximately the same for every oscillator. Defining $\mu'=\mu\omega_o/2Q$ and $^{\lambda'}=\mu\omega_o/2Q$, where 107 $_o$ is an average angular frequency for the oscillator ensemble, yields $$A_i=\mu'(1-A_i^2)A_i+\lambda'f_i(A,\Delta\theta)\quad i=1,2,\ldots,N \quad \text{(Eq. 22)}$$

-continued $$\Delta\theta_i = \Delta\omega_i + \lambda' g_i(A,\Delta\theta) \quad i = 2, 3, \ldots, N$$

where $$f_i(A,\Delta\theta) = A_{i-1}\cos(\Phi + \Delta\theta_i) + A_{i+1}\cos(\Phi - \Delta\theta_{i+1}) \qquad \text{(Eq. 23)}$$

$$g_i(A,\Delta\theta) = \frac{A_{i-2}}{A_{i-1}}\sin(\Phi + \Delta\theta_{i-1}) + \frac{A_i}{A_{i-1}}\sin(\Phi - \Delta\theta_i) - \frac{A_{i-1}}{A_i}\sin(\Phi + \Delta\theta_i) - \frac{A_{i+1}}{A_i}\sin(\Phi - \Delta\theta_{i+1})$$

and where $A_0=A_{N+1}=0$ is assumed. For $\lambda=0$ the oscillators are uncoupled, and Eq. (22) and (23) reduce to a set of isolated limit cycle oscillators with amplitudes $A_i=1$ and frequencies $\omega_i$.

Equation (23) can be considered a modified version of Adler's equation. For loose coupling and a narrow distribution of oscillator frequencies, the amplitudes will remain close to the free-running values, and the oscillator dynamics will be essentially governed by Eq. (23). In this case all of the oscillators in the system may lock to a single frequency, associated with stable, fixed points. The parameter $\lambda'$ in Eq. (22) and (23) is closely related to the locking bandwidth of the oscillators. Thus for widely varying oscillator frequencies such that $\Delta\omega_i>\lambda$, the oscillators may not lock to a single frequency. In this case the amplitude dynamics described by Eq. (22) can not be ignored and both $A_i$ and $\Delta\theta_i$ will be functions of time in the steady-state. This is the regime in which mode-locking can occur.

The second term on the right of Eq. (23) gives the nonlinear frequency corrections due to the mutual pulling effects of the oscillators. Previous experiments indicate that if the set of frequencies $\omega_i$ are chosen properly, then the system of oscillators will settle into a mode-locked state in which the conditions for mode-locking are satisfied. Computer simulations of Eq. (23) have been performed which corroborate the measurements, indicating the validity of the model. A system of three coupled oscillators is the simplest and easiest situation—for both simulation and measurement—which preserves the salient features of mode-locking, and will be assumed in the discussion below.

There are several parameters in equations (22) and (23) which influence the behavior of the solutions. The following values were chosen based on measurements of experimental oscillator arrays:

$$f_o = 10\text{ GHz} \quad \mu = 0.1$$
$$Q = 20 \quad \lambda = 0.05$$

and the oscillator frequencies were chosen to be $f_i=f_o+i\,\Delta f$, where i=−1, 0 and 1 for three oscillators. For this case there are two phase differences $\Delta\theta_2$ and $\Delta\theta_3$, permitting a graphical phase-plane construction for the presentation of simulation results. The output waveform for this system is given by $$\left(\sum_{i=-1}^{1} A_i\cos\theta_i\right)^2 \qquad \text{(Eq. 24)}$$

In the following, only the envelope of Eq. (24) will be presented for clarity, and this is obtained by removing the carrier frequency, $f_0$.

Figure 16:
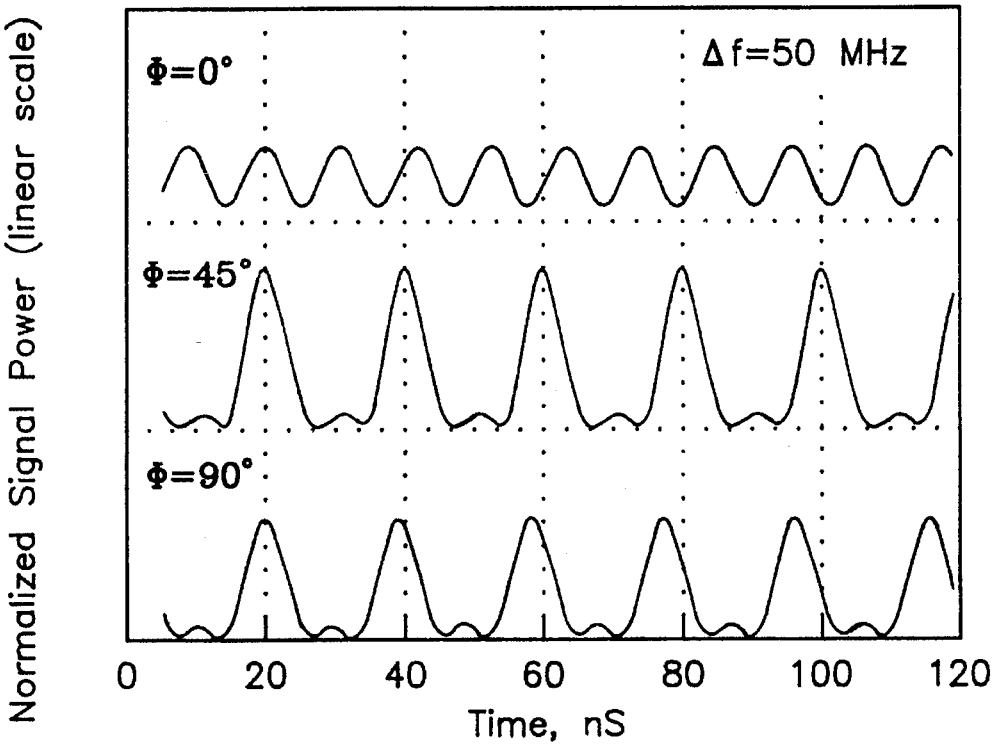
FIG. 16 is the calculated output from a three element mode-locked array for three different values of the coupling phase angle ($\Phi$) with the frequency separation fixed at 50 MHz.

FIG. 16 shows simulation results for both the phase-plane trajectories and signal waveforms in the case of $\Delta f$=50 MHz and several values of the coupling phase angle, Φ. For this frequency separation the mutual pulling effects are fairly weak, but strong enough to enforce mode-locking. The output waveform is observed to be critically dependent on the value of the coupling phase angle. For Φ=0 the output envelope bears little resemblance to the desired pulse train, due to the destructive behavior of the phase. By varying Φ a nearly ideal 3-mode pulse envelope was generated when Φ=60°.

Figure 17:
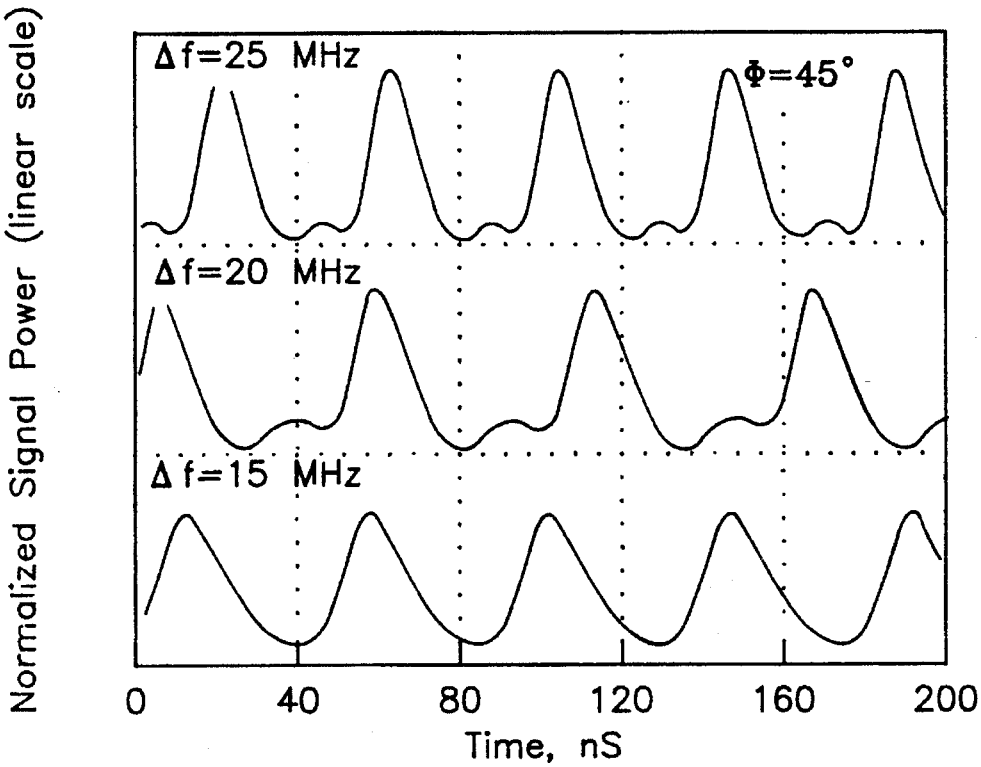
FIG. 17 is the calculated output from a three element mode-locked array with the coupling phase angle ($\Phi$=45°) and the frequency separation between elements varied.

The mode-locked waveform is also greatly affected by the frequency separation between the oscillators. FIG. 17 illustrates this for three different values of $\Delta f$, with Φ held constant at Φ=45°. As the frequency separation is reduced, mutual pulling effects between the oscillators increase. When the frequency separation reaches $\Delta f$=15 MHz, the phase plot and output waveform change significantly. In this case the first oscillators have, on the average, the same fundamental frequency, and the output waveform appears qualitatively similar to the expected output of two mode-locked oscillators. If the frequency separation is reduced further, the oscillators will all lock to the same frequency. The oscillators tend to mode-lock even if the free-running frequencies are not exactly equally spaced, provided they were set sufficiently close to that situation, as was observed experimentally.

These simulations indicate that a properly designed mode-locked array should have a coupling phase Φ≈60° with the mutual pulling effects kept as low as possible. The latter could be accomplished by increasing the frequency separation, increasing the oscillator Q-factor, or decreasing the coupling strength, $\lambda$. This must be balanced against the ability to set the free-running frequencies of the oscillators, however, since weak interactions requires stricter control over the frequency distribution. Thus, there has been disclosed a new mode of operation for an array of coupled microwave oscillators wherein each oscillator is embedded in a printed radiating structure to form a classical antenna array. The oscillators are coupled through weak radiative interactions and by equally spacing the output frequencies of each oscillator, a phenomenon similar to laser mode-locking is obtained. The output from the array consists of a train of high-power RF pulses which scan automatically through the space above the array. Although the present invention is described in terms of a preferred embodiment, it will be apparent that numerous modifications and variations may be provided without departing from the true spirit and scope of the invention as described in the following claims.

What is claimed is:

1. An antenna array for radiating high power microwave and millimeter wavelength signals, comprising:

a plurality of oscillator elements in side-by-side relationship, each element including an active device and a radiator;

bias means connected to each of said elements for producing, in each element, free oscillation at a different frequency, said elements each producing a corresponding radiated output signal; and means including mutual coupling of said output signals producing mode locking of all said oscillator elements due to pulling effects to provide a resultant radiated signal from said array, the composite signal having a power determined by the number of oscillator elements.

2. The array of claim 1, wherein said bias means is adjustable for adjusting the frequency of free oscillation of each of said oscillator elements.

3. The array of claim 2, wherein said means producing mode locking further includes reflector means adjacent said oscillator elements and located to reflect said radiated signals, said reflector cooperating with said elements to form a cavity.

4. The array of claim 1, wherein said means producing mode locking further comprises modulator means supplying a modulating signal to at least one of said oscillator elements.

5. The array of claim 4, wherein said means producing mode locking further includes a reflector adjacent said oscillator elements and located to reflect said radiated signals, said reflector cooperating with said elements to form a cavity.

6. The array of claim 1, wherein said bias means connected to each of said elements is adjustable, each said bias means being adjusted to operate said oscillator elements at different, equally spaced frequencies, whereby said output signals from one element are coupled to adjacent elements to produce said mode locking.

7. The array of claim 6, wherein said means producing mode locking further includes a reflector adjacent said oscillator elements and located to reflect said radiated signals, said reflector cooperating with said elements to form a cavity.

8. The array of claim 6, wherein each said oscillator element has a locking bandwidth, and wherein said bias means is adjusted to produce a difference between the frequencies at which adjacent elements are operated which is greater than the locking bandwidths of said oscillator elements to prevent said oscillator elements from locking to a single frequency.

9. The array of claim 8, wherein said means producing mode locking further includes a reflector adjacent said oscillator elements and located to reflect said radiated signals, said reflector cooperating with said elements to form a cavity.

10. The array of claim 1, wherein said means producing mode locking further includes reflector means spaced above said array.

11. The array of claim 1, wherein said means producing mode locking further comprises modulator means providing a modulating signal at a selected difference frequency, and means supplying said difference frequency to modulate at least one of said elements.

12. The array of claim 5, wherein said modulating difference frequency is selected to produce from adjacent elements radiative signals having frequencies spaced by said difference frequency.

13. The array of claim 7, further including reflector means adjacent said oscillator elements and located to reflect said radiative signals, said reflector cooperating with said elements to form a cavity.

14. The array of claim 1, wherein said oscillator elements are spaced apart to produce scanning of said resultant radiated signal with respect to said elements.

15. The array of claim 14, wherein said resultant radiated signal has a maximum available power when the spacing between adjacent elements is small, said maximum available power being proportional to the square of the number of oscillator elements in said array, said composite radiated signal having less than said maximum available power when said element are spaced apart.

16. An antenna array for radiating high power microwave and millimeter wavelength signals, comprising:

a plurality of oscillators in side-by-side relationship, each oscillator having a radiator for producing a radiative signal;

bias means connected to supply an individual bias signal to each said oscillator to produce free oscillation thereof, whereby each oscillator produces a corresponding radiative signal at a different frequency determined by the bias signal;

said oscillators being spaced apart and having radiation patterns which produce mode locking of all said oscillators due to mutual pulling effects to thereby produce a resultant radiative signal which when the spacing between oscillators is small, has a maximum power, said oscillators being spaced apart to produce scanning of said resultant signal.

17. The array of claim 16, wherein said resultant signal has a maximum power proportional to the square of the number of oscillators when said oscillators are spaced sufficiently closely together to prevent scanning of said resultant signal, said resultant signal having less than maximum power when said oscillators are spaced to produce said scanning.

18. The array of claim 16, wherein said bias signal to each oscillator is selected to produce said radiative signals at different, equally spaced frequencies to thereby produce a resultant radiative signal comprising a periodic train of high power output pulses.

19. The array of claim 18, wherein said oscillators are spaced apart by approximately one wavelength of one of said oscillator frequencies to thereby produce scanning of said resultant signal.

20. The array of claim 18, further including reflector means adjacent said oscillators and located to reflect said radiative signals.

21. The array of claim 16, further including frequency modulator means connected to at least one of said oscillators.

22. An antenna array for radiating high power microwave and millimeter wavelength signals, comprising:

a plurality of oscillator elements in side-by-side relationship, each element including an active device and a radiator, adjacent elements being spaced apart and operating at a different free oscillation frequency, said elements each producing a corresponding radiated output signal; and means including mutual coupling of said output signals producing mode locking of all said oscillator elements due to pulling effects to provide output radiated scanning signals having a power determined by the number of oscillator elements.

23. The array of claim 22, wherein said output radiated scanning signals have a maximum power dependant on the square of the total number of oscillators, the available output power being dependant on the spacing of said elements.

24. An antenna array for radiating high power microwave and millimeter wavelength signals, comprising:

a plurality of oscillator elements in side-by-side relationship, each element including an active device and a radiator, adjacent elements being spaced apart and operating at a different free oscillation frequency, said elements each producing a corresponding radiated output signal; and means including mutual coupling of said output signals producing mode locking of all said oscillator elements due to pulling effects to provide output radiated scanning signals having a power determined by the number of oscillator elements and having a total peak proportional to the square of the number of oscillator elements in said array.

* * * * *